United States Patent [19]

Yeargin

[11] 4,333,231

[45] Jun. 8, 1982

[54] WIRE RELEASE TOOL

[76] Inventor: Homer E. Yeargin, 7004 N. 11th Pl., Phoeniz, Ariz. 85020

[21] Appl. No.: 162,680

[22] Filed: Jun. 25, 1980

Related U.S. Application Data

[63] Continuation-in-part of Ser. No. 7,041, Jan. 29, 1979, abandoned.

[51] Int. Cl.[3] ..... H01R 43/00

[52] U.S. Cl. ..... 29/764; 7/165; 29/758

[58] Field of Search ..... 29/764, 758; 81/3 R; 220/352; 145/61 E, 61 EA; 7/107, 108, 165; 401/202, 243

[56] References Cited

U.S. PATENT DOCUMENTS

| | | | |
|---|---|---|---|
| 2,196,849 | 4/1940 | Beeg | 7/165 X |
| 3,252,446 | 5/1966 | Bateman | 220/352 X |
| 3,578,870 | 5/1971 | Viti | 401/202 X |
| 3,824,670 | 7/1974 | Clark | 29/758 X |
| 4,083,101 | 4/1978 | Collar | 29/758 X |

*Primary Examiner*—Carl E. Hall

*Attorney, Agent, or Firm*—Cahill, Sutton & Thomas

[57] ABSTRACT

A wire release tool includes first and second working ends for releasing stripped conductors from electrical switches, wall outlets, lighting fixtures, receptacles and other electrical devices of the types which include a spring-biased detent tongue for engaging the stripped conductor. Electrical devices of this type generally include a socket for receiving the stripped conductor and an opening of either circular or rectangular shape to afford access to the detent tongue. The wire release tool includes a central metal core having first and second ends, a metal pin extending longitudinally from the first end and a metal blade extending longitudinally from the second end. The metal pin includes a working end of uniformly circular cross-section having a diameter substantially equal to the diameter of the circular access opening of such electrical devices. The metal blade includes a working end having a uniformly rectangular cross-section having dimensions substantially equal to the dimensions of rectangular access openings within such electrical devices. A plastic body is molded about the central metal core, while plastic caps are provided for covering the working ends of the wire release tool when they are not being used. Each of the plastic caps includes a skirt for removably and frictionally engaging the molded plastic body. One of the caps is provided with a clip for securing the wire release tool in the pocket of a user when the tool is not being used.

9 Claims, 14 Drawing Figures

WIRE RELEASE TOOL

CROSS-REFERENCE TO RELATED APPLICATION

This application is a continuation-in-part of copending patent application, Ser. No. 007,041, filed Jan. 29, 1979, by Homer E. Yeargin, and entitled "WIRE RELEASE TOOL", abandoned upon the filing of the present application.

BACKGROUND OF THE INVENTION

1. Field of the Invention

The present invention relates generally to electrical switches, wall outlets, lighting fixtures, receptacles and other electrical devices of the type which utilize spring-biased detent tongues for engaging stripped conductors connected to such electrical devices, and more particularly, to a wire release tool having two working ends for releasing stripped conductors from two different types of such electrical devices.

2. Description of the Prior Art

Presently, several electrical equipment manufacturers provide electrical switches, electrical wall outlets, lighting fixtures, receptacles and other electrical devices of the type in which stripped conductors are connected to the electrical device by inserting the end of the stripped conductor into a socket. Adjacent the socket is an elastic or spring-biased metal tongue which extends inwardly from the point of entry of the stripped conductor into the socket. As the stripped conductor is inserted into the socket, the detent tongue is displaced and compressed. The end of the detent tongue is so formed to include an indentation that tends to bite into the stripped conductor when an attempt is made to withdraw the conductor from the socket. Such electrical devices typically include a small opening adjacent the socket for providing access to the spring-biased detent tongue that engages the stripped conductor inserted within the socket. Such access openings are generally either circular or rectangular in shape.

To applicant's knowledge, there is no tool presently available which is adapted to fit within such access openings for quickly and conveniently releasing stripped conductors from the sockets of such electrical devices. Tools having tapered working ends such as screwdrivers are not suitable for releasing stripped conductors from such electrical devices because the taper prevents the working end from extending sufficiently deep into the access opening to reach the detent tongue; additionally, bladed tools are clearly not well suited for being inserted within small access openings of circular shape.

Attempts to forcibly withdraw the stripped conductor from the socket of the electrical device usually result in breakage of the spring-biased detent tongue. Accordingly, it is now a common practice of electricians, when working on electrical installations utilizing such electrical devices, to cut the conductors connected to such an electrical device and to discard it, replacing it with a similar electrical device. It is estimated that millions of such electrical devices are discarded each year. This practice is obviously wasteful and results in significant additional expense.

Accordingly, it is an object of the present invention to provide a tool for releasing stripped conductors from sockets within electrical devices of the type which utilize spring-biased detent tongues for engaging the stripped conductors.

It is another object of the present invention to provide a tool for releasing stripped conductors from sockets within electrical devices utilizing spring-biased detent tongues for engaging stripped conductors wherein the tool is adapted for use with electrical devices of either the type having a circular access opening for providing access to the detent tongue or of the type having a rectangular access opening for providing access to the detent tongue.

It is still another object of the present invention to provide a tool for releasing stripped conductors from sockets within electrical devices utilizing detent tongues for engaging stripped conductors wherein the tool serves to electrically insulate the user from voltages conducted by such electrical devices.

It is a further object of the present invention to provide a tool for releasing stripped conductors from sockets within electrical devices utilizing detent tongues for engaging stripped conductors wherein the working ends of the tool are covered when the tool is not being used for protecting the user.

It is a still further object of the present invention to provide such a tool which can easily be kept on the person of the user whereby the tool is readily accessible whenever it is needed.

These and other objects of the present invention will become apparent to those skilled in the art as the description thereof proceeds.

SUMMARY OF THE INVENTION

Briefly, and in accordance with one embodiment thereof, the present invention relates to a wire release tool for releasing stripped conductors from sockets within electrical switches, wall outlets, lighting fixtures, receptacles and other electrical devices utilizing spring-biased detent tongues to engage the stripped conductors inserted within the sockets. Such electrical devices are generally of the type which include an opening of either circular or rectangular shape adjacent to the socket for affording access to the detent tongue. The wire release tool includes a central core of metal having first and second ends. A metal pin extends longitudinally from the first end of the central core and includes a working end having a uniformly circular cross-section along its length, the circular cross-section having a diameter substantially equal to the diameter of the circular access openings provided within electrical devices having such circular access openings. The length of the working end of the metal pin exceeds the depth of the circular opening for allowing the working end of the metal pin to be inserted into the circular opening of the electrical device sufficiently deep to bias the detent tongue away from the stripped conductor inserted within the socket of the electrical device. A metal blade extends longitudinally from the second end of the central core and has a working end having a uniformly rectangular cross-section along its length. The cross-sectional dimensions of the working end of the metal blade are substantially equal to the dimensions of the rectangular access openings provided within electrical devices having such rectangular access openings. The length of the working end of the metal blade exceeds the depth of the rectangular access openings for allowing the working end of the metal blade to be inserted into the rectangular shaped access opening of the electrical device sufficiently deep to bias the detent tongue away from the stripped conductor inserted within the socket of the electrical device. The wire release tool further includes a body of electrically insulating material formed about and secured to the central core of metal.

Preferably, the wire release tool includes a pair of removable caps which are disposed over the metal pin and metal blade, respectively, and which engage the body of electrically insulating material with a friction fit. One of the caps is provided with a clip for securing the wire release tool to the person of the user when not in use.

DESCRIPTION OF THE PREFERRED EMBODIMENT

Figure 1:
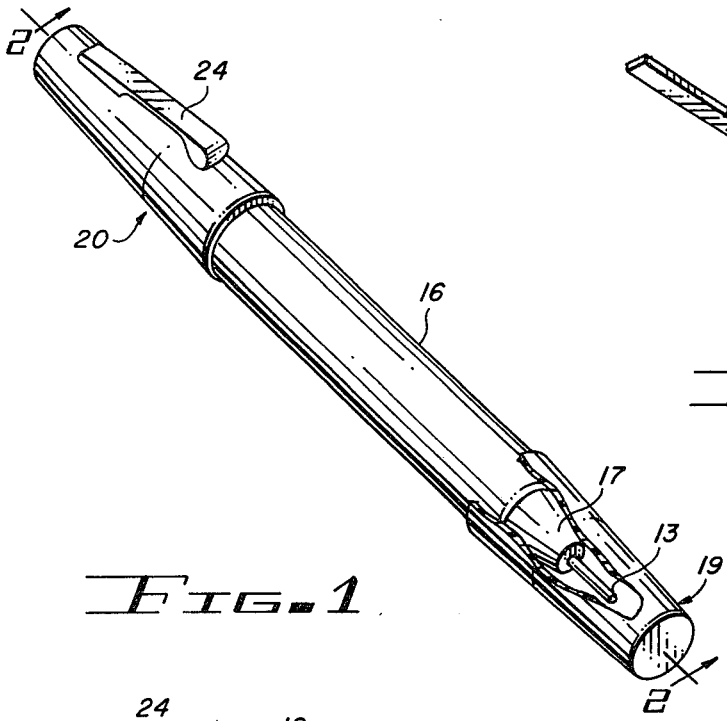
FIG. 1 is a perspective view of a wire release tool according to the teachings of the present invention and wherein one of the caps removably attached to the tool is partially broken away to illustrate a metal pin extending longitudinally from one end of the tool.
Figure 3:
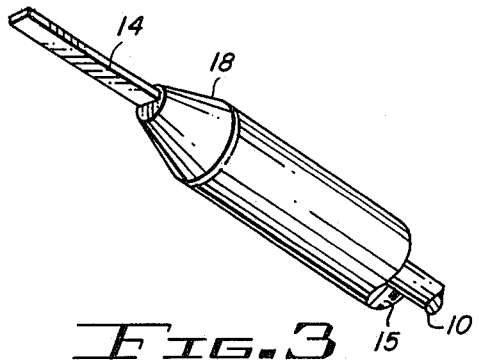
FIG. 3 is a perspective view illustrating one end of the tool from which a metal blade extends longitudinally.

Referring to FIGS. 1–6, a wire release tool is illustrated and includes a central core of metal 10 which is cylindrically shaped. As shown best in FIG. 2, central core 10 has a conical portion 11 at one end and a ridge 12 at the other end. Extending longitudinally from conical portion 11 of central core 10 is a solid cylindrical metal pin having a working end opposite conical portion 11. The working end of metal pin 13 has a uniformly circular cross-section along its length, the diameter of which is made substantially equal to or slightly smaller than the diameter of the circular access openings within electrical devices of the type providing circular access openings adjacent the sockets thereof. The length of the working end of metal pin 13 exceeds the depth of such circular access openings for allowing the working end of metal pin 13 to be inserted into the circular access openings sufficiently deep to bias the detent tongues within such electrical devices away from the inserted stripped conductors.

Extending longitudinally from ridge 12 of central metal core 10 is a metal blade 14 which has a working end opposite ridge 12. The working end of metal blade 14 has a uniformly rectangular cross-section along its length. The length and width dimensions of the uniformly rectangular cross-section of the working end of metal blade 14 are substantially equal to or slightly smaller than the length and width dimensions of the rectangular access openings within electrical devices of the type providing rectangular access openings adjacent the sockets thereof. The length of the working end of metal blade 14 exceeds the depth of such rectangular access openings for allowing the working end of metal blade 14 to be inserted into the rectangular access openings sufficiently deep to bias the detent tongues within such electrical devices away from the inserted stripped conductors.

Figure 2:
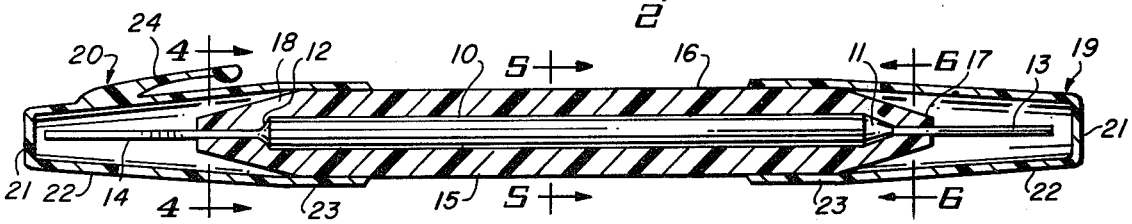
FIG. 2 is a longitudinal cross-sectional view of the wire release tool with both caps assembled thereon taken through lines 2—2 shown in FIG. 1.
Figure 5:
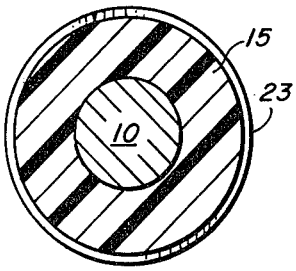
FIG. 5 is a cross-sectional view through the central core portion of the tool taken through lines 5—5 as shown in FIG. 2.
Figure 4:
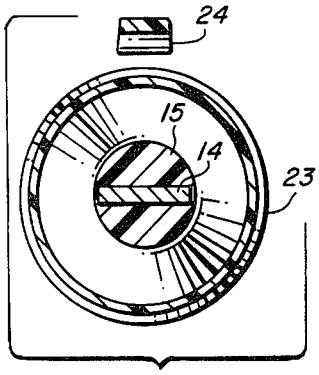
FIG. 4 is a cross-section through the metal blade end of the tool with a cap assembled thereon taken through lines 4—4 shown in FIG. 2.
Figure 6:
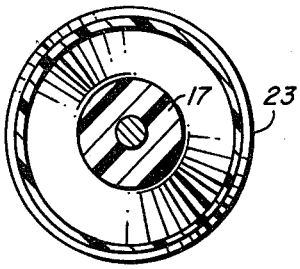
FIG. 6 is a cross-sectional view through the metal pin end of the tool with a cap assembled thereon taken through lines 6—6 shown in FIG. 2.

A body of insulating material 15, such as molded plastic, is formed about and secured to central core 10. Body 15 may also extend over conical portion 11, ridge 12, and the inner end portions of metal pin 13 and metal blade 14, as shown in FIG. 2. Body 15 has a cylindrical outer surface 16 and frusto-conical end portions 17 and 18.

A pair of removable caps 19 and 20 are provided for covering metal pin 13 and metal blade 14. Caps 19 and 20 each include a flat end wall 21 and a slightly tapered conical wall 22 which terminates in a cylindrical skirt 23 for frictionally engaging an end portion of cylindrical surface 16. The frictional engagement of skirt 23 with cylindrical surface 16 maintains the cap assembled on the body, yet permits the cap to be removed therefrom. A conventional clip 24 is formed integral with conical wall 22 of cap 20 for securing the tool in the pocket of the user's clothing. It will be apparent to those skilled in the art that frusto-conical end portions 17 and 18 of body 15 serve to guide caps 19 and 20, respectively, onto cylindrical outer surface 16. It will also be apparent to those skilled in the art that caps 19 and 20 may be readily fitted over cylindrical surface 16 regardless of the angular relation of caps 19 and 20 to body 15.

Preferably, central core 10, metal pin 13 and metal blade 14 are each made of hardened steel. Were metal pin 13 and metal blade 14 made of a relatively soft material, then the working ends of pin 13 and blade 14 could themselves become retained within the electrical devices by the detent tongues therein.

During actual use of the wire release tool, one of the working ends of the tool is forced into an access opening of an electrical device while the cap at the other end provides adequate and comfortable backing for the hand of the user pressing against the tool. For example, when metal blade 14 is to be used, cap 20 is removed to expose metal blade 14 while cap 19 is left assembled on body 15; therefore, the user may apply pressure to end wall 21 of cap 19 in a comfortable manner and at the same time supply sufficient pressure to metal blade 14 to bias the detent tongue away from the stripped conductor so that the stripped conductor can be withdrawn from the socket of the electrical device. Similarly, when metal pin 13 is to be used, cap 19 is removed while cap 20 is left in assembled position on body 15.

Figure 7:
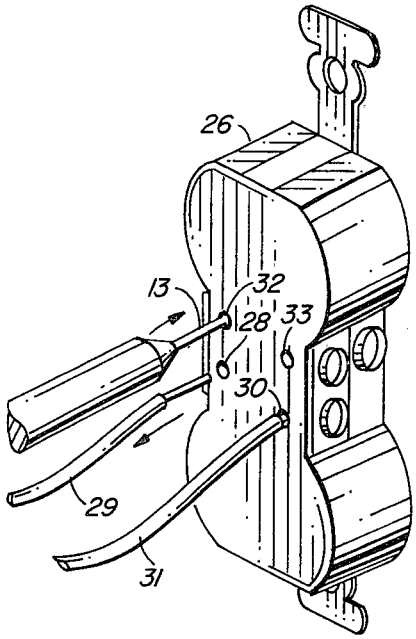
FIG. 7 is a perspective view of a wall outlet or electrical receptacle of the type having a circular access opening and illustrates the use of a wire release tool constructed according to the teachings of the present invention for releasing a stripped conductor from a socket of the electrical receptacle.

Various types of electrical devices are now being manufactured which utilize such spring-biased detent tongues for retaining stripped conductors within sockets of the electrical devices. For example, in FIG. 7, a wall outlet or electrical receptacle is generally identified by reference numeral 26 and includes a socket 28 for receiving the stripped end of conductor 29; similarly, a second socket 30 is provided for receiving the stripped end of second conductor 31. Circular shaped access openings 32 and 33 are provided for allowing access to the spring-biased detent tongues which grippingly engage the stripped ends of conductors 29 and 31, respectively. As shown in FIG. 7, the working end of metal pin 13 has a diameter substantially equal to the diameter of access opening 32. The working end of metal pin 13 is inserted within access opening 32 to a sufficient depth for releasing the stripped end of conductor 29 from the detent tongue, allowing the user to withdraw conductor 29 from socket 28.

Figure 8:
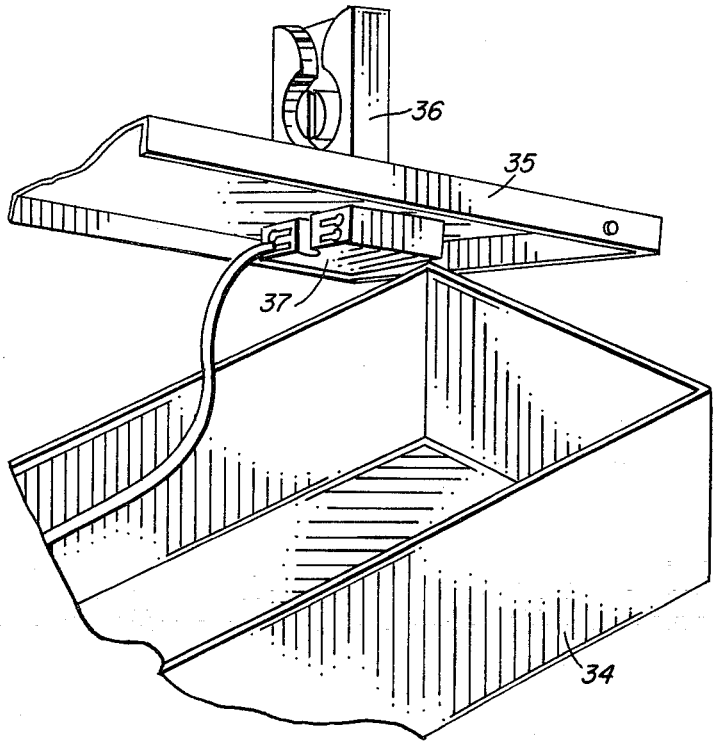
FIG. 8 is a perspective view of a portion of fluorescent light fixture of the type which provides a rectangular shaped access opening.
Figure 9:
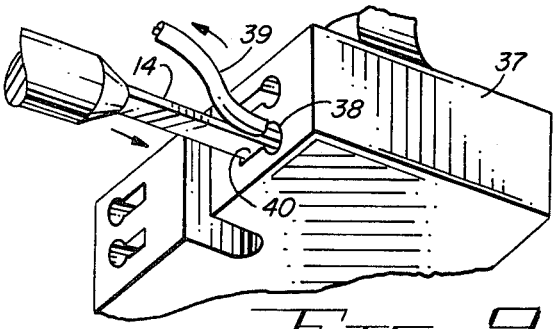
FIG. 9 is an enlarged view of the fixture shown in FIG. 8 and illustrates the use of a wire release tool constructed according to the teachings of the present invention for releasing a stripped conductor from a socket within the fixture.

In FIG. 8, a fluorescent lighting fixture box includes a base portion 34 and a cover portion 35. Projecting through cover portion 35 is a fixture element 36 for engaging one end of a fluorescent lighting tube. A portion 37 of fixture element 36 is normally hidden by cover 35. As shown in the enlarged view of portion 37 illustrated by FIG. 9, portion 37 includes a plurality of sockets, one of which is designated 38, each for engaging the stripped end of a conductor, such as 39. Adjacent each of the plurality of sockets within portion 37 is a rectangularly shaped slot or access opening 40 for providing access to the detent tongue which grippingly engages the stripped conductor inserted within the adjacent socket. As shown in FIG. 9, the working end of metal blade 14 of the wire release tool is forced into rectangular access opening 40 to a sufficient depth for freeing the stripped end of conductor 39 from the detent tongue within socket 38.

Figure 10A:
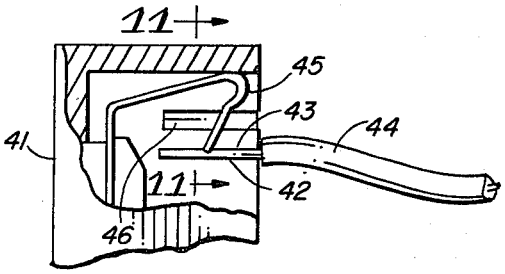
FIG. 10A is a cross-sectional view of an electrical device having a spring-biased detent tongue for engaging a stripped conductor inserted within a socket of the electrical device.
Figure 11:
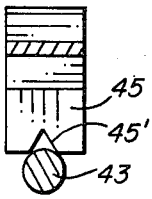
FIG. 11 is a cross-sectional view of the detent tongue and stripped conductor taken through lines 11—11 in FIG. 10A.

FIG. 10A illustrates a typical electrical device utilizing a spring-biased detent tongue for engaging a stripped conductor inserted into the socket of the electrical device. The electrical device 41 includes a socket 42 for receiving the stripped end 43 of conductor 44. Spring-biased detent tongue 45 grippingly engages stripped end 43 of conductor 44. As shown in FIG. 11, the edge of detent tongue 45 which engages stripped end 43 is so formed as to include an indentation 45' which tends to bite into stripped end 43 when an attempt is made to pull conductor 44 from socket 42. As shown in FIG. 10A, electrical device 41 also includes an access opening 46 which is typically either cylindrical or rectangular in shape.

Figure 10B:
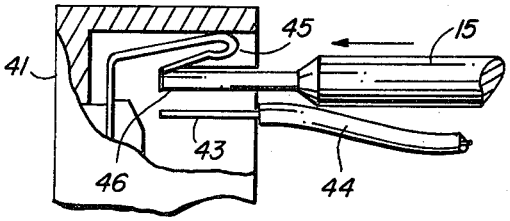
FIG. 10B is a view similar to that shown in FIG. 10A and illustrates how the detent tongue is biased away from the stripped conductor after one of the working ends of the wire release tool is inserted into the access opening.

Referring to FIG. 10B, the working end of the wire release tool which most closely corresponds to the shape of the particular access opening 46 is inserted therein to a sufficient depth to engage detent tongue 45 and to bias it away from stripped end 43 of conductor 44; the user may then simply pull on conductor 44 to withdraw stripped end 43 from socket 42. Since the working ends of metal pin 13 and metal blade 14 are made of hardened steel, the indentation 45' within the edge of detent tongue 45 can not bite into either of the working ends of the tool. Thus, the working ends of the tool can easily be slid out of the access opening after the stripped conductor has been withdrawn.

Figure 12:
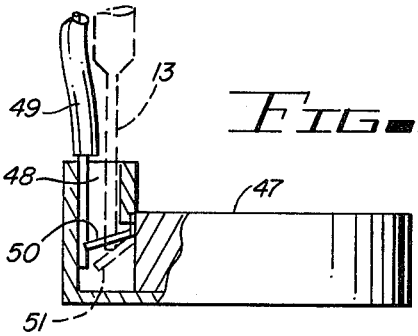
FIG. 12 is a cross-sectional view of another type of electrical device including spring-biased detent tongues for engaging stripped conductors.

FIG. 12 illustrates yet another type of electrical device which utilizes a spring-biased detent tongue for engaging a stripped conductor inserted within the socket of the electrical device. Electrical device 47 includes a socket 48 for receiving the stripped end of conductor 49. Detent tongue 50 engages the stripped end of conductor 49 for retaining it within the socket. Socket 48 is slightly larger than the stripped end of conductor 49, and a small opening remains within socket 48 after the stripped end of conductor 49 has been inserted therein for providing access to spring-biased detent tongue 50. The working end of metal pin 13 of the wire release tool is inserted within the remaining opening available within socket 48 to bias detent tongue 50 away from the stripped end of conductor 49 to dashed position 51.

Figure 13:
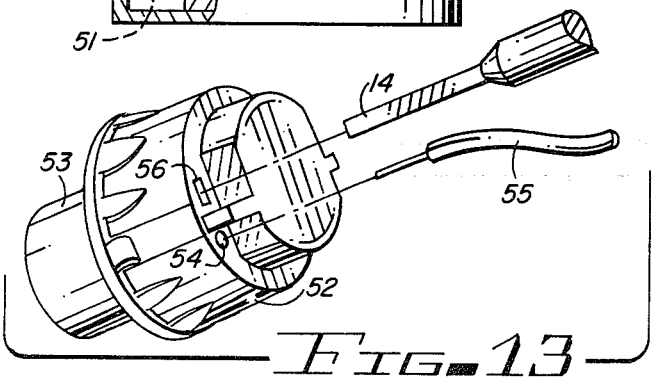
FIG. 13 is a perspective view of yet another type of electrical device including spring-biased detent tongues for engaging stripped conductors.

In FIG. 13, yet another type of electrical device is illustrated with which the wire release tool constructed according to the teachings of the present invention may be utilized. The electrical device includes a base portion 52 and a spring-biased light fixture portion 53 for engaging one end of a fluorescent tube. Base portion 52 includes a socket 54 for receiving the stripped end of conductor 55. A rectangular shaped access opening 56 is also provided within base portion 52 for providing access to a detent tongue which engages the stripped end of conductor 55 inserted within socket 54. The working end of metal blade 14 is forced into rectangular access opening 56 to a sufficient depth for biasing the detent tongue away from the stripped end of conductor 55 to permit the withdrawal of conductor 55 from socket 54. The dimensions of the cross-section of the working end of metal blade 14 are substantially equal to or slightly smaller than the dimensions of rectangular opening 56 for allowing the passage of metal blade 14 therein.

It should be appreciated by those skilled in the art that a wire release tool has been provided which may be utilized for releasing stripped conductors from virtually all types of electrical devices which include spring-biased detent tongues for grippingly engaging stripped conductors inserted within the sockets of such electrical devices. While the present invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. A wire release tool for releasing stripped conductors from sockets within electrical devices of the type utilizing spring-biased detent tongues to engage stripped conductors inserted within the sockets thereof, the spring-biased detent tongues normally preventing withdrawal of the stripped conductors from the sockets, the electrical devices being of the type which include access openings of either circular or rectangular shape adjacent the sockets thereof to afford access to said detent tongues, the circular access openings having a predetermined diameter and a first predetermined depth, the rectangular access openings having a predetermined length and width and a second predetermined depth, said wire release tool comprising in combination:

a. a central core of metal having first and second ends;

b. a metal pin for traversing one of said circular access openings and contacting one of said spring-biased detent tongues in engagement with a stripped conductor and biasing said tongue away fron said conductor, said metal pin extending longitudinally from the first end of said central core, said metal pin having a working end opposite the first end of said central core, the working end having a uniformly circular cross-section along its length having a diameter substantially equal to said predetermined diameter and said working end having a length in excess of said first predetermined depth for allowing said working end of said metal pin to be inserted into a circular access opening of an electrical device of the type which includes circular access openings to a sufficient depth to bias the detent tongue away from the stripped conductor inserted within the socket adjacent the circular access opening;

c. a metal blade for traversing one of said rectangular access openings and contacting one of said spring-biased detent tongues in engagement with a stripped conductor and biasing said tongue away from said conductor, said metal blade extending longitudinally from the second end of said central core, said metal blade having a working end opposite the second end of said central core, said working end having a uniformly rectangular cross-section along its length, the rectangular cross-section having a length and width substantially equal to said predetermined length and width, respectively, and said working end having a length in excess of said second predetermined depth for allowing said working end of said metal blade to be inserted into a rectangular access opening of an electrical device of the type which includes rectangular access openings to a sufficient depth to bias the detent tongue away from the stripped conductor inserted within the socket adjacent the rectangular access opening; and d. a body of electrically insulating material formed about and secured to said central core of metal.

2. A wire release tool as recited in claim 1 further including a pair of caps each of which is removably assembled on one end of said body of electrically insulating material, one of said caps being disposed over said metal pin, and the other of said caps being disposed over said metal blade.

3. A wire release tool as recited in claim 2 wherein said pair of caps each engage said body of electrically insulating material with a friction fit.

4. A wire release tool as recited in claim 2 wherein said body of electrically insulating material has a cylindrical outer surface and wherein said pair of caps each includes a skirt which engages the cylindrical outer surface of said body of insulating material with a friction fit.

5. A wire release tool as recited in claim 4 wherein said body of electrically insulating material has frustoconical end portions for guiding each of said caps onto the cylindrical outer surface of said body of electrically insulating material.

6. A wire release tool as recited in claim 2 wherein one of said caps includes a clip for securing said wire release tool to the person of a user.

7. A wire release tool as recited in claim 1 wherein said body of electrically insulating material is molded plastic.

8. A wire release tool as recited in claim 1 wherein said central core, said metal pin and said metal blade are each made of steel.

9. A wire release tool as recited in claim 8 wherein said steel is hardened steel.

* * * * *